United States Patent [19]

Davis et al.

[11] Patent Number: 4,716,830

[45] Date of Patent: Jan. 5, 1988

[54] INERTIA SAFETY AND ARMING DEVICE

[75] Inventors: Willard F. Davis, Brigham City; Douglas G. Bullard, Ogden, both of Utah

[73] Assignee: Morton Thiokol, Inc., Chicago, Ill.

[21] Appl. No.: 760,227

[22] Filed: Jul. 29, 1985

[51] Int. Cl.[4] ..... F42C 9/02; F42C 15/40

[52] U.S. Cl. ..... 102/248; 102/264

[58] Field of Search ..... 89/1.812; 102/247, 248, 102/249, 262, 264, 223, 228, 250, 251

[56] References Cited

U.S. PATENT DOCUMENTS

| | | | |
|---|---|---|---|
| 2,164,115 | 6/1939 | Lasserre | 102/249 |
| 2,595,757 | 5/1952 | Brandt | 102/249 |
| 2,660,952 | 12/1953 | Mohaupt | 102/223 |
| 2,721,913 | 10/1955 | Kent | 102/262 |
| 2,863,393 | 12/1958 | Sheeley | 102/249 |
| 3,994,234 | 11/1976 | Litz | 102/5111 |
| 4,046,076 | 9/1977 | Hampton | 102/262 |
| 4,154,168 | 5/1979 | Campbell | 102/343 |
| 4,188,886 | 2/1980 | Brauer | 102/223 |
| 4,574,168 | 3/1986 | Devaney | 102/262 |

FOREIGN PATENT DOCUMENTS

| | | | |
|---|---|---|---|
| 2488394 | 2/1982 | France | 102/223 |

*Primary Examiner*—Stephen C. Bentley
*Assistant Examiner*—Stephen M. Johnson
*Attorney, Agent, or Firm*—Gerald K. White

[57] ABSTRACT

An inertial mass is forced from an initial position against a compression spring by sustained acceleration of a predetermined value to travel to the end of a zig-zag channel where it is locked into place in engagement with four contacts and thereby enables an electric circuit for the firing of a squib by a firing command signal. When the firing command is given, the squib fires and the resulting pressure forces a piston to break a shear pin and move whereby the hot gases are forced into a flame tube hole previously blocked by the piston. The hole may be packed with ignition granules which speed propogation of the flame to an igniter. In the event the squib is fired inadvertently with the inertial mass in the initial position thereof, the piston is restrained by the inertial mass and cannot move to unblock the flame tube hole. As a result, the hot gases are retained harmlessly in the space provided.

3 Claims, 6 Drawing Figures

INERTIA SAFETY AND ARMING DEVICE

BACKGROUND OF THE INVENTION

1. Field of the Invention

The present invention relates to an improvement in missile inertial safety and arming devices and the methods of operation thereof.

2. Description of the Prior Act

Various safety and arming devices have been proposed in the prior art for preventing accidental arming and premature ingition of ordnance devices. The ignition of flares or the explosion of bombs or missiles during handling, shipping or in storage creates a highly dangerous condition.

Percussion fuze devices have been proposed in which a fuze normally held inoperative by a safety device is released by setback forces developed upon launching of a projectile. Such a fuze is shown in U.S. Pat. No. 1,652,635 which was issued on Dec. 13, 1927 to B. Pantoflicek.

Another type of fuze device has been propoesd in which a slide mechanism moving in a zig-zag groove responds to setback forces developed during sustained acceleration of a projectile to arm the fuze. Devices of this type are disclosed in the following U.S. patents:

U.S. Pat. No. 2,595,757 issued to E. W. Brandt on May 6, 1953;

U.S. Pat. No. 2,666,390 issued to E. W. Brandt on Jan. 19, 1954;

U.S. Pat. No. 2,712,284 issued to H. E. Thomas, et al. on July 5, 1955;

A further type of fuze device has been proposed wherein movement of a setback slide mechanism pivots a lever and initiates a timing mechanism to release a detonator carrier which is moved into an armed position. Such devices are shown in the following U.S. patent:

U.S. Pat. No. 2,863,393 issued to E. N. Sheeley on Dec. 9, 1958;

U.S. Pat. No. 3,139,828 issued to J. Delaney, et al. on July 7, 1964;

U.S. Pat. No. 3,724,385 issued to B. D. Beatty, et al. on Apr. 3, 1973;

U.S. Pat. No. 3,890,901 issued to M. E. Anderson, et al. on June 24, 1975.

The prior art safety and arming devices of the prior art exhibit a high degree of sophistication in their development and construction. They are, however, rather bulky and complex, involving components that are difficult to manufacture and assemble. There is, therefore, a need and a demand, particularly for use with missiles, of an improved safety and arming device that will fit into a cavity of the propellant of an advanced missile system. Such a device has to be small, lightweight and preferably arm only after the previous stage of a missile has been fired successfully.

SUMMARY OF THE INVENTION

An object of the invention is to provide an improved method for establishing a flow of hot gases through the flame tube hole of an inertial safety and arming device to the igniter of a missile.

Another object of the invention is to provide an inertial safety and arming device that is simple in construction, easily and inexpensively manufactured and assembled, and that may be lightweight and small enough to fit into the cavity of the propellant of a missile.

An additional object of the invention is to provide such a device that will arm only after the previous stage of a missile has been fired successfully.

A further object of the invention is to provide such a device which is certain and reliable in operation, arming only after the missile has been subjected to sustained acceleration above a predetermined value, and which is unresponsive to, and hence, safe from accidental shocks to which the device may be subjected prior to firing of the missile.

Still another object of the invention is to provide such a device that is operative, in the event of inadvertent firing although not armed, to retain harmlessly therein the resulting hot gases.

In accomplishing these and other objectives of the invention, there is provided an inertial arming and safety device that is armed by sustained acceleration of a given value. The acceleration pulls an inertial mass and a pin down a shaft along a zig-zag channel, compressing a spring. The zig-zags in the channel prevent the inertial mass from moving the full distance when subjected to a sharp shock such as might result from dropping the device, but allows the mass to move along the full length of the shaft when subjected to sustained acceleration. When the mass reaches the end of the shaft, it is locked in place and engages four electrical slider contacts. These contacts complete a firing circuit to a squib for enabling the squib to receive a subsequently applied firing command signal. The squib cannot receive the firing command signal unless the mass is locked and touching the contacts. When a firing command is given, the squib is fired, and the resulting pressure forces a piston in a cylinder to break a shear pin and to move. The piston movement continues until it hits a stop. An O-ring around the piston and continuing in contact with the cylinder walls maintains a seal whereby the hot gases resulting from the firing of the squib are forced through a flame tube hole or opening that previously had been blocked by the piston. The hole may be packed with ignition granules which speed propagation of the flame to the igniter.

In accordance with the invention, if for some reason the squib inadvertently fires before the inertial mass has been pulled down the shaft from its initial position, the piston is restrained by the inertial mass and cannot move to unblock the flame tube hole whereby the hot gases resulting from the firing of the squib are harmlessly retained in a space provided within the device.

The various features of novelty which characterize the invention are pointed out with particularity in the claims annexed to and forming a part of the specification. For a better understanding of the invention, its operating advantages, and specific objects attained by its use, reference is made to the accompanying drawings and descriptive matter in which a preferred embodiment of the invention is illustrated.

DESCRIPTION OF THE PREFERRED EMBODIMENT

Figure 1:
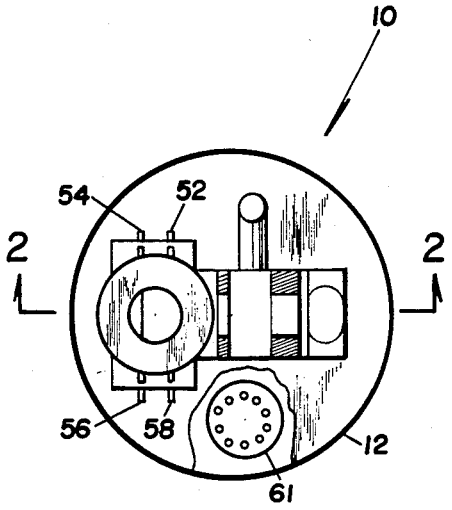
FIG. 1 is a top view of the inertial safety and arming device according to the invention showing in dotted outline certain of the components contained therein.

There is provided in the preferred embodiment, illustrated in the drawings, a missile inertial safety and arming device that is characterized by its small size and light weight. The device is designated generally by the reference numeral 10 and includes an outer casing 12 which may be made of 4130 steel, having a first or lower portion 14 and a second or upper portion 16 that forms a closure for the casing 12.

After assembly of the various components of the device 10, as hereinafter described, within the casing 12, the upper closure portion 16 may be attached in any suitable manner to the lower closure portion 14.

Figure 2:
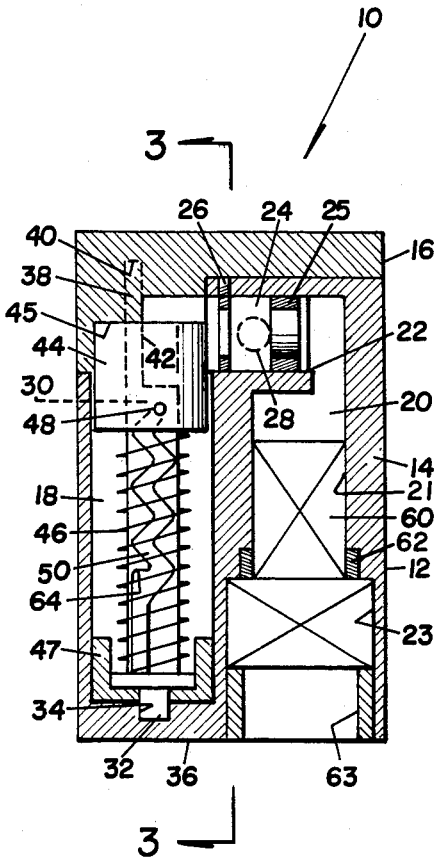
FIG. 2 is a cross sectional view taken along the lines 2—2 of FIG. 1, but for clarity, showing a shaft having a longitudinal zig-zag channel along the periphery thereof rotated 90° counterclockwise from a perferred position along the longitudinal axis thereof.
Figure 3:
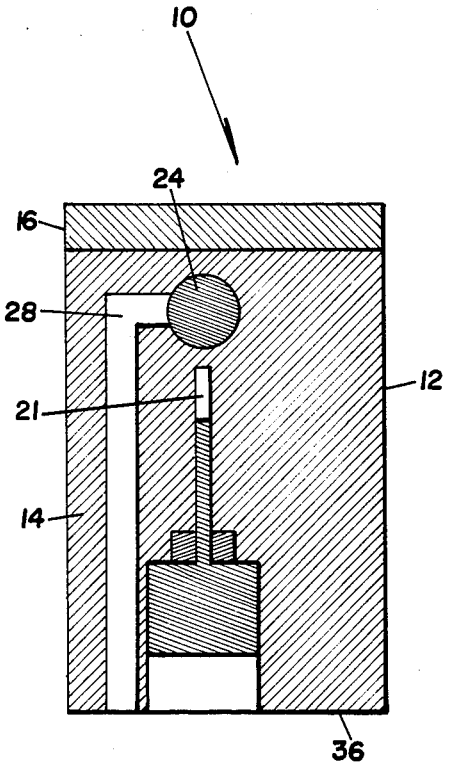
FIG. 3 is a cross sectional view taken along the lines 3—3 of FIG. 2.

Formed within casing 12 is a first chamber 18 which is cylindrical, and a second chamber 20. The second chamber 20, as best seen by reference to FIGS. 2 and 3 has an upper portion 21 that is rectangular in shape and a lower portion 23 that is cylindrical in shape. Connecting the upper ends of chambers 18 and 20, as seen in FIG. 2, is a cylindrical opening or passage 22 having a piston 24 therein. Piston 24, sealed by an 0-ring 25, is normally retained fixed in position in opening 22 by a shear pin 26. In this fixed position, piston 24 blocks and, hence, seals a flame tube hole 28 in the wall of passage 22 from communication with the second chamber 20. In the operation of the device 10, piston 24 is adapted to be forced to the left, partially into the first chamber 18, shearing the shear pin 26, and thus unblocking the flame tube hole 28 for communication with the second chamber 20. The flame tube hole 28, as best seen in FIGS. 2 and 3, branches downwardly parallel to chambers 18 and 20 and opens to the exterior of the casing 12 through the bottom of the lower body portion 14 thereof.

Fixedly positioned in the first chamber 18 is a cylindrical shaft 30. The lower end of shaft 30 has an integral center post 32 that extends into a centering hole 34 in the base 36 of the casing portion 14 and an upper end 38 that extends into an opening 40 provided in the casing closure portion 16. A "D-cut" 42 provided in the end portion of shaft 30 opposite the cylindrical opening 22 retains shaft 30 against rotation and allows the piston 24 to move a sufficient distance into the first chamber 18 to unblock the flame tube hole 28. The D-cut in the shaft 30 provides a stop for the piston 24, and additionally, facilitates alignment of the shaft along the longitudinal axis of chamber 18.

Surrounding shaft 30 in chamber 18 is a heavy walled sleeve inertial mass 44. Sleeve 44 is biased upwardly, as seen in FIG. 2, by a spring 46 into engagement with a first stop 45 provided on the upper closure portion 16 of casing 12. One end of spring 46 engages the sleeve 44 and the other end thereof is received in a cup-like member 47 at the other end of chamber 18. As shown, the centering post 32 on the end of shaft 30 extends through a hole in cup member 47 into the centering hole 34 in base 36 of casing portion 12.

Sleeve 44 is adapted, as the result of setback forces developed during acceleration of the device 10 in the direction indicated by the arrow 49, to move relatively to the shaft 30 against the force of the spring 46. Union between the sleeve 44 and the shaft 30 is achieved during such movement by means of a slide pin 48 carried by mass 44 that is adapted to run along a longitudinally disposed zig-zag groove or channel 50 that is provided on the periphery of shaft 30.

Positioned in the first chamber 18, adjacent the lower end of shaft 30, are four electrical slider contacts 52, 54, 56 and 58, as best seen in FIG. 1. These contacts are electrically connected in a firing control circuit (not shown) to a squib 60, which may be a dual bridgewire type, that is positioned in the lower cylindrical portion 23 of the second chamber 20 and having a portion that extends into the upper rectangular portion 21 of chamber 20, as shown in the drawings. The firing circuit, although not shown, includes an electrical connector 61, as shown in FIG. 1, which may be located on the casing closure member 16, and which internally of the casing 12 is suitably connected to the squib 60 and the slider contacts 52, 54, 56 and 58 by connecting wires (not shown).

It is noted that the slider contacts 52, 54, 56 and 58 may be of a type between which an electric circuit is closed by electric conduction through sleeve 44. In such case, sleeve 44 must provide an electrically conductive surface in engagement with the contacts. Alternatively, the slider contacts may be of a type that enable an electric circuit to the squib 60 by effecting closure upon themselves as the result of pressure exerted upon them by the sleeve 44. In that case, sleeve 44 need not provide an electrically conductive surface in engagement with the contacts and need not be made of an electrically conductive material. Squib 60 is sealed in chamber 20 by an 0-ring 62, being retained therein by a sleeve 63 that may be press fit into the lower end of chamber 20.

Acceleration of the device 10 of a predetermined value in the direction of the arrow 49 pulls the inertial mass 44 and the pin 48 down along the shaft 30 along the zig-zag channel 50 against the force of spring 46. The zig-zags in the channel 50 prevent the mass 44 from moving the full distance along the shaft 30 when the device 10 is exposed or subjected to a sharp shock, such as a drop, but allows the mass 44 to move the full length of the shaft 30 when subjected to sustained acceleration. The acceleration necessary to cause arming can be predetermined by proper selection of the mass of the sleeve 44 and the strength of the spring.

When the mass 44 reaches the lower end of shaft 30, it engages the slider contacts 52, 54, 56 and 58 and is locked into place by the pin 48 hooking up on a sharply divergent portion 64 of the channel 50 and being retained in engagement therewith by the force of spring 46.

Figure 6:
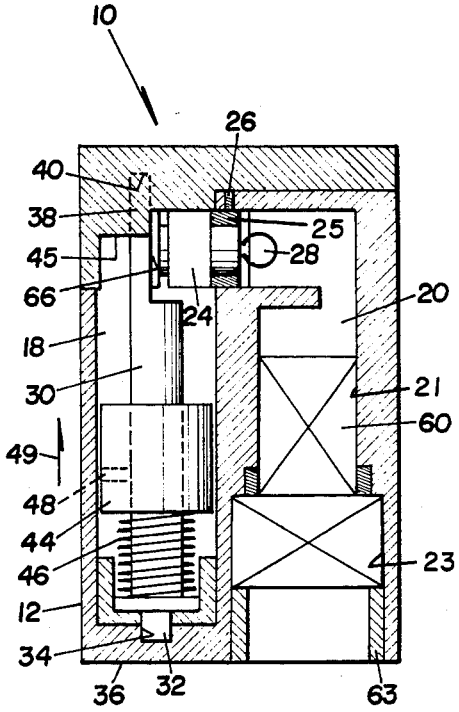
FIG. 6 is a view showing the inertial safety and arming device in its "FIRED" condition.

When a firing command is subsequently given by way of the firing control circuit, the squib 60 is fired. The resulting pressure of gas in the chamber 20 forces the piston 24 to move to the left to a second position, as seen in FIG. 6, breaking the shear pin 26. The piston 24 reaches the end of such movement when it hits the stop 66 which is provided at the upper end of shaft 30. In second position of piston 24, the 0-ring 25 on the piston 24 is still in contact with the walls of cylindrical opening 22 and maintains a seal. As a result, the hot gases produced by the squib 60 are forced through the flame tube hole 28 that now has been unblocked due to the movement of piston 24 to the left into engagement with stop 66. The hole 28 may be packed with ignition granules (not shown) which speed propagation of the flame to an igniter (not shown) for the missile propellant.

Figure 4:
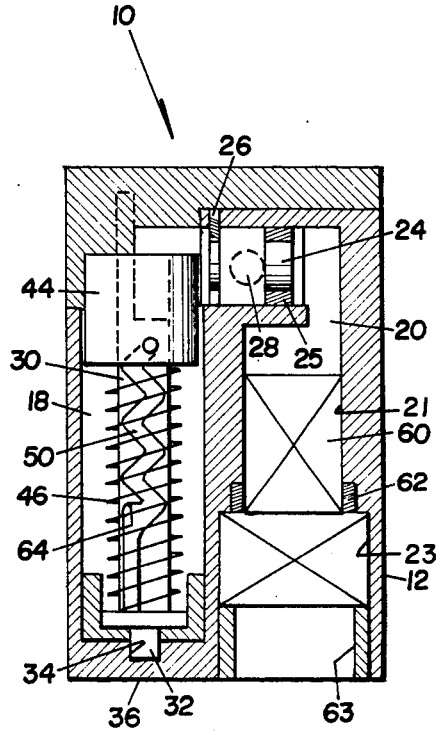
FIG. 4 is a view showing the "SAFE" condition of the inertial safety and arming device with the shaft having a zig-zag channel thereon shown in its preferred angular position.

In the "SAFE" condition of the device 10, as shown in FIG. 4, it will be noted that the inertial mass 44 is positioned at the upper end of chamber 18 opposite the cylindrical opening 22 and piston 24. If for some reason, for example, exposure of the device 10 to an abnormally high temperature, the squib 60 should fire inadvertently with the inertial mass 44 in the upper end of chamber 18, the piston 24 is restrained by the inertial mass 44 from moving to the left into chamber 18, and hence, cannot open communication between the flame tube hole 28 and the second chamber 20. As a result, the hot gases are retained harmlessly within the chamber 20, thereby avoiding what might otherwise have been a highly dangerous condition had the hot gasses from the squib 60 been permitted to escape through the flame tube hole 28.

Figure 5:
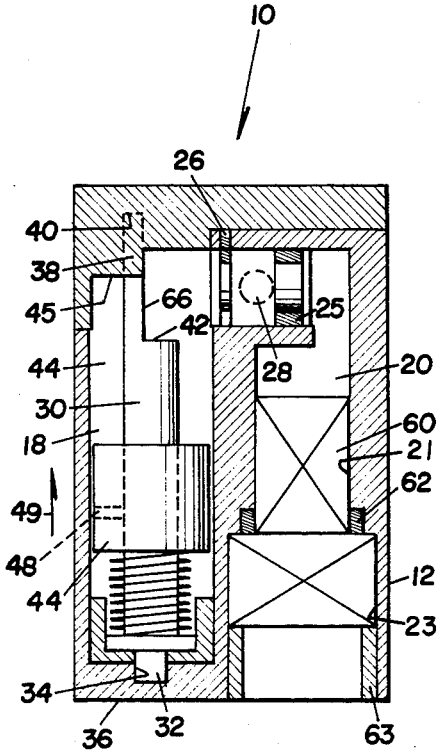
FIG. 5 is a view showing the "ARMED" condition of the inertial safety and arming device.

FIG. 5 illustrates the "ARMED" condition of the device 10, showing the inertial mass 44 locked in place in the position in which it is in engagement with the electric contacts 52, 54, 56 and 58.

In FIG. 6 there is shown the "FIRED" condition of the device 10, with the inertial mass 44 still in its locked position and the piston 24 partially within the first chamber 18 abutted against stop 66 whereby the flame hole 28 has been placed in communication with the second chamber 20, thus allowing the hot gases produced by the squib 60 to pass to the missile propellant igniter (not shown).

Thus, in accordance with the invention, there has been provided an improvement in inertial safety and arming devices and the methods of operation thereof. The improvement is characterized by the simplicity of the components required, the ease of their manufacture and assembly, and their adaptability for being made of lightweight materials and in size small enough to fit in a cavity in the propellant of a missile.

What is claimed is:

1. An inertial safety and arming device comprising, casing means forming a first chamber and a second chamber each of which have a first end and a second end, said casing means further including a cylindrical passage connecting the first ends of said first and second chambers, said cylindrical passage having a flame tube hole in the wall thereof, piston means in said cylindrical passage and normally in a first position blocking the flame tube hole but movable to a second position to unblock the flame tube hole, wherein in the second position thereof said piston means extends partially into said first chamber.

cylindrical shaft means having a first end and a second end and having a zig-zag channel disposed longitudinally along a portion of the periphery thereof, means for supporting said cylindrical shaft means within said first chamber with said cylindrical shaft means extending between the first end and the second end of said first chamber, sleeve means having a heavy wall and forming an inertial mass positioned in surrounding relation with said cylindrical shaft means and having a slide pin attached thereto that is constrained to slide in said zig-zag channel as said sleeve is moved along the length of said cylindrical shaft means, first stop means in said first chamber positioned adjacent the first end thereof, wherein said cylindrical shaft means, at the first end thereof, has a portion of the length thereof opposite the cylindrical passage cut away to allow further movement of said piston means into the first chamber, said cylindrical shaft means at said cut away portion providing a second stop means, said second stop means limiting the extent of movement of said piston means into the first chamber.

spring means normally biasing said inertial sleeve against said first stop means, squib means contained in said second chamber adjacent the second end thereof, electrical contact means disposed in said first chamber adjacent the second end thereof and adapted to be engaged by said sleeve means, said electrical contact means being operative when so engaged to enable an electric circuit for the firing of said squib means by a firing command signal, the zig-zag in the channel on said shaft cooperating with said spring means to prevent said sleeve means from moving the full distance from the first end to the second end of said first chamber when the inertial safety and arming device is subjected to sharp shock but allowing said sleeve means to move such full distance in response to sustained acceleration thereof to engage said electrical contact means, and means for locking said sleeve means in place when moved such full distance into engagement with said electrical contact means, whereby upon the application of a firing command signal to said squib means through said electric contact means the resulting pressure of hot gases in said second chamber forces said piston means to move from the first position thereof to the second position thereof thereby to unblock the flame tube hole for the passage therethrough of hot gases.

2. An inertial safety and arming device as defined in claim 1 wherein the first chamber is cylindrical in shape and has a longitudinal axis, wherein said cylindrical shaft means extends along the longitudinal axis of the first chamber and, at the second end thereof, includes a centering post, said centering post being received by a hole in said casing at the second end of the first chamber and in alignment with the longitudinal axis thereof, and wherein the portion of said cylindrical shaft means, at the first end thereof that is cut away is a D-cut, the remaining portion of the first end of said cylindrical shaft means being received in a correspondingly shaped hole in said casing adjacent the first end of the first chamber and in alignment with the longitudinal axis thereof, thereby facilitating the alignment of said cylindrical shaft means along the longitudinal axis of the first chamber.

3. An inertial safety and arming device comprising, casing means forming a first chamber and a second chamber each of which have a first end and a second end, said casing means further including a cylindrical passage connecting the first ends of said first and second chambers, said cylindrical passage having a flame tube hole in the wall thereof, piston means in said cylindrical passage and normally in a first position blocking the flame tube hole but movable to a second position to unblock the flame tube hole, cylindrical shaft means having a first end and a second end and having a zig-zag channel disposed longitudinally along a portion of the periphery thereof, means for supporting said cylindrical shaft means within said first chamber with said cylindrical shaft means extending between the first end and the second end of said first chasmber, sleeve means having a heavy wall and forming an inertial mass positioned in surrounding relation with said cylindrical shaft means and having a slide pin attached thereto that is constrained to slide in said zig-zag channel as said sleeve is moved along the length of said shaft means, first stop means in said first chamber positioned adjacent the first end thereof, spring means normally biasing said inertial sleeve against said first stop means, squib means contained in said second chamber adjacent the second end thereof, wherein the first and second chambers each have a longitudinal axis, the longitudinal axis of the first chamber being substantially parallel to the longitudinal axis of the second chamber, and wherein the flame tube hole extends for a first portion of its length from said cylindrical passage in a direction at a right angle to the plane containing the longitudinal axes of the first and second chambers, and extends for a second portion of its length in a direction parallel to the longitudinal axes of the first and second chambers, wherein the direction of the second portion of the length of the flame tube hole is toward the end of the casing adjacent the second ends of the first and second chambers, electrical contact means disposed in said first chamber adjacent the second end thereof and adapted to be engaged by said sleeve means, said contact means being operative when so engaged to enable an electric circuit for the firing of said squib means by a firing command signal, the zig-zags in the channel of said cylindrical shaft cooperating with said spring means to prevent said sleeve means from moving the full distance from the first end to the second end of said first chamber when the inertial safety and arming device is subjected to sharp shock but allowing said sleeve means to move such full distance in response to sustained acceleration thereof to engage said electrical contact means, and means for locking said sleeve means in place when moved such full distance into engagement with said electrical contact means, whereby upon the application of a firing command signal to said squib means through said electric contact means the resulting pressure of hot gases in said second chamber forces said piston means to move from the first position thereof to the second position thereof thereby to unblock the flame tube hole for the passage therethrough of hot gases.

* * * * *